US005741123A

United States Patent [19]

Pauly

[11] Patent Number: 5,741,123

[45] Date of Patent: Apr. 21, 1998

[54] TURBOCHARGER COMPRESSOR FAN AND HOUSING

[76] Inventor: Lou Allen Pauly, 460 S. 500 East, Green River, Wyo. 82935

[21] Appl. No.: 761,148

[22] Filed: Dec. 6, 1996

Related U.S. Application Data

[63] Continuation-in-part of Ser. No. 588,440, Jan. 18, 1996, abandoned.

[51] Int. Cl.[6] ..... F04B 17/00

[52] U.S. Cl. ..... 417/407; 123/565; 416/183; 416/186 R; 416/223 A; 416/223 B

[58] Field of Search ..... 416/175, 178, 416/183, 186 R, 187, 188, 198 A, 201 R, 185, 203, 223 A, 223 B; 415/198.1, 199.6, 204, 206, 208.3, 228; 123/561, 565; 417/407; 60/607, 608

[56] References Cited

U.S. PATENT DOCUMENTS

| | | | |
|---|---|---|---|
| 2,585,029 | 2/1952 | Nettel | 60/606 |
| 3,479,017 | 11/1969 | Thiköttter | 416/186 R |
| 3,489,340 | 1/1970 | Holzhausen | 415/204 |
| 4,502,837 | 3/1985 | Blair et al. | 416/183 |
| 4,850,193 | 7/1989 | Kawamura | 60/608 |
| 4,924,674 | 5/1990 | Hara et al. | 417/407 |
| 5,215,439 | 6/1993 | Jansen et al. | 416/183 |
| 5,560,208 | 10/1996 | Halimi et al. | 60/608 |

FOREIGN PATENT DOCUMENTS

| | | | |
|---|---|---|---|
| 0832548 | 3/1952 | Germany | 416/183 |
| 2535878 | 2/1977 | Germany | 416/185 |

*Primary Examiner*—Christopher Verdier
*Attorney, Agent, or Firm*—Marcus G. Theodore

[57] ABSTRACT

A turbocharger compressor impeller structured as a combination elevated auxiliary blades fan surrounded by a curved inducer which provides a high gas volume low speed turbocharger compressor to deliver pressured gas into a combustion engine.

8 Claims, 7 Drawing Sheets

TURBOCHARGER COMPRESSOR FAN AND HOUSING

RELATED APPLICATIONS

This application is a continuation-in-part application of the original application Ser. No. 08/588,440 entitled "Impeller and Housing" filed Jan. 18, 1996, now abandoned.

BACKGROUND OF THE INVENTION

1. Field

This invention pertains to turbocharger compressor fans and housings. More particularly, it provides a low speed high gas volume turbocharger compressor fan and housing.

2. State of the Art

Numerous turbocharger devices to pressurize and increase the density of the the intake air entering an internal combustion engine are known. As discussed in Chapter 2 of *H P Books, Turbochargers,* © 1984, Berkley Publishing Group, typical turbochargers have a compressor on one end with a shaft connected to a turbine drive on the other end. The shaft is bearing supported with seals between the bearings and the compressor and turbine to prevent high pressure gases from leaking into an oil-drainage area of the housing supporting the bearings. The centrifugal compressor of the turbocharger has three main elements that must be matched for optimum efficiency: the impeller, the diffuser, and the housing.

The impeller is mounted within a housing having an air intake and has a shaft driven by turbine, pneumatic drive, electric drive, or mechanical drive means to rotate the impeller at very high speeds to accelerate gases passing therethrough to a high velocity by centrifugal force into a collector diffuser. The diffuser acts as a nozzle in reverse to slow down the gas without turbulence. Slowing down the gas causes it to increase in pressure and temperature. The diffuser surrounds the impeller and collects and directs the high-pressure gas into the air inlet of an internal combustion engine.

The designs of compressor impellers are generally of three types: a) a 90° radial wheel having a straight-blade inducer section having all blade elements lying on straight lines that pass through the center of the impeller hub; b) a radial wheel having curved blades, curving away from the direction of rotation such that the angle of curvature at the inlet of the inducer blades is designed so that air entering the impeller will be at approximately the same angle as the blades to reduce inlet losses to a minimum; and c) a radial wheel having backward-curved blades curving backward into the direction of rotation. The impeller blades have a decreasing cross sectional height gradually decreasing in height as the distance of a blade segment increases from the axle center. The latter two types of impellers may be covered by a shroud having a center segment uncovered, but covering the remaining tops of the blades.

Centrifugal gas diffusers collecting the gases accelerated by the impeller are generally of three types: a) a scroll type consisting of a volute or snail shape around the outside of the impeller having a cross-sectional area increasing in proportion to the amount of air coming from the impeller to slow the gas down and convert velocity energy into pressure energy; b) a parallel wall diffuser which increases in area from the inside diameter of the diffuser to the outside diameter such that gas flowing in a radial direction has the gas velocity at the outer diameter of the diffuser considerably less than at the inner diameter of the diffuser to slow the gas down and convert velocity energy into pressure energy; and c) vane-type diffusers where a plurality of curved vanes are designed so that their leading edges will be in line with the direction of gas flow from the impeller such that the vane curvature will force the gas to flow and be slowed down to convert the velocity energy into pressure energy.

Cited for general interest are various pumps for handling liquids: Thikotter, U.S. Pat. No. 3,479,017, an impeller for charging a liquid with gas, particularly for aerating sewage in the activated sludge process; Kempf, U.S. Pat. No. 3,759,628, a vortex pump for handling solids-bearing liquids; Emerick,. U.S. Pat. No. 2,266,180 providing an impeller for a centrifugal pump to move conglomerate mixtures; Ransohoff, U.S. Pat. No. 2,618,223 directed to an improvement in the fabrication of a centrifugal pump housing; Johnston, U.S. Pat. No. 3,741,679 providing an improved impeller sealing arrangement which substantially reduces seal failure or leakage of a pump; and Eberhardt, U.S. Pat. No. 4,245,952 disclosing a centrifugal pump with a cast iron impeller.

Present turbocharger impeller designs have restricted air intake areas which do not optimize the amount of gas flowing through the impellers; thus requiring higher revolutions per minute to move additional gas flows. The invention described below provides a lower speed turbocharger impeller which provides the same gas flows and pressures.

SUMMARY OF THE INVENTION

The invention comprises a turbocharger compressor fan and housing. The housing has a gas inlet leading into an interior compression chamber. Within the interior compression chamber is structure to seat an impeller and direct air flows into a collection diffuser.

An impeller is rotatably mounted within the interior of the compression chamber in communication with the air inlet. The impeller has a flat bottom and is of a circular impeller disc shape to form a drive segment. A drive shaft is attached to the center of the impeller disc bottom. The drive shaft is bearing mounted to the housing and operably associated with centrifugal drive means, such as an exhaust gas turbine, a mechanical or electrical motor, or a pneumatic pump. To collect and dissipate compression heat buildup, the bearing section of the housing may include a circulating oil bath surrounding the shaft.

The top of the impeller is a combination elevated auxiliary blades collecting and directing gas into a surrounding downward curved inducer which forms a high volume low speed fan when seated and turned within the compression chamber. The shape of the impeller top is an elevated central mound forming a sloping undersurface.

The auxiliary blades fan segment is centrally mounted on top of the central mount. It has an open top leading into an interior gas intake opening in communication with the housing gas inlet. Surrounding the interior gas intake are a plurality of fan blades which form fixed cross section fan blade outlets therebetween. This auxiliary blades fan segment collects higher volumes of air within its interior gas intake opening than conventional inducers and which is then directed out the fan blade outlets by the fan blades. In addition to collecting and directing higher volumes of gas through the inducer segment, in the event of a backfire, the wider interior gas intake opening enables the impeller to suffer less damage.

The inducer segment surrounding the auxiliary blades fan has a plurality of curved downward sloping impeller inducer blades secured to the periphery of the fan blades proximate their fan blade outlets and the sloping undersurface of the top of the disc. These inducer blades extend radially in a radial sloping wheel configuration such that each impeller inducer blade curves away from the direction of disc rotation. The angle of inducer blade curvature at the inlet of the inducer blades allows the air entering the impeller inducer segment to be at approximately the same angle as the inducer blades to minimize inlet losses. Each inducer blade has an inner elevated leading edge and an outer trailing edge. The height of each inducer blade decreases from the leading edge to the trailing edge. When the impeller is seated, these edges form with the undersurface flow channels which are downwardly open along their length and of a constant cross-sectional area throughout the length of each channel to minimize restriction of gas flows therethrough. These channels lead to an inducer gas outlet which is of the same cross-sectional area as the fixed cross sections of the fan outlets, thus directing high speed gas therethrough without interference.

A centrifugal gas diffuser surrounds and is in communication with each inducer gas outlet to collect the gases accelerated by the impeller and slow the gas down. This diffuser collection process converts the gas velocity energy into increased gas pressure and directs it into an internal combustion engine.

The centrifugal gas diffuser may be of a scroll type structure, a parallel wall diffuser structure, or a vane-type diffuser structure which increase the pressure and volume of the air entering the internal combustion engine to provide increased engine performance.

The impeller is generally of one piece construction made by die casting, investment, or the rubber-pattern process. Any high strength, lightweight material, such as aluminum alloys may be used to make the impeller. If desired, different contours can be machined on the cast wheels to allow use on both turbine-wheel and compressor-impeller castings for more than one flow-size turbocharger.

Also, the top of the impeller blade segment may be covered by a shroud. However, these shrouds have a tendency to increase dirt buildup during operation, requiring additional maintenance.

The above combination auxiliary blades/curved inducer impeller thus provides a high gas volume low speed turbocharger compressor which does not require as much centrifugal drive to deliver pressured gas into a combustion engine.

DESCRIPTION OF THE ILLUSTRATED EMBODIMENTS

Figure 1:
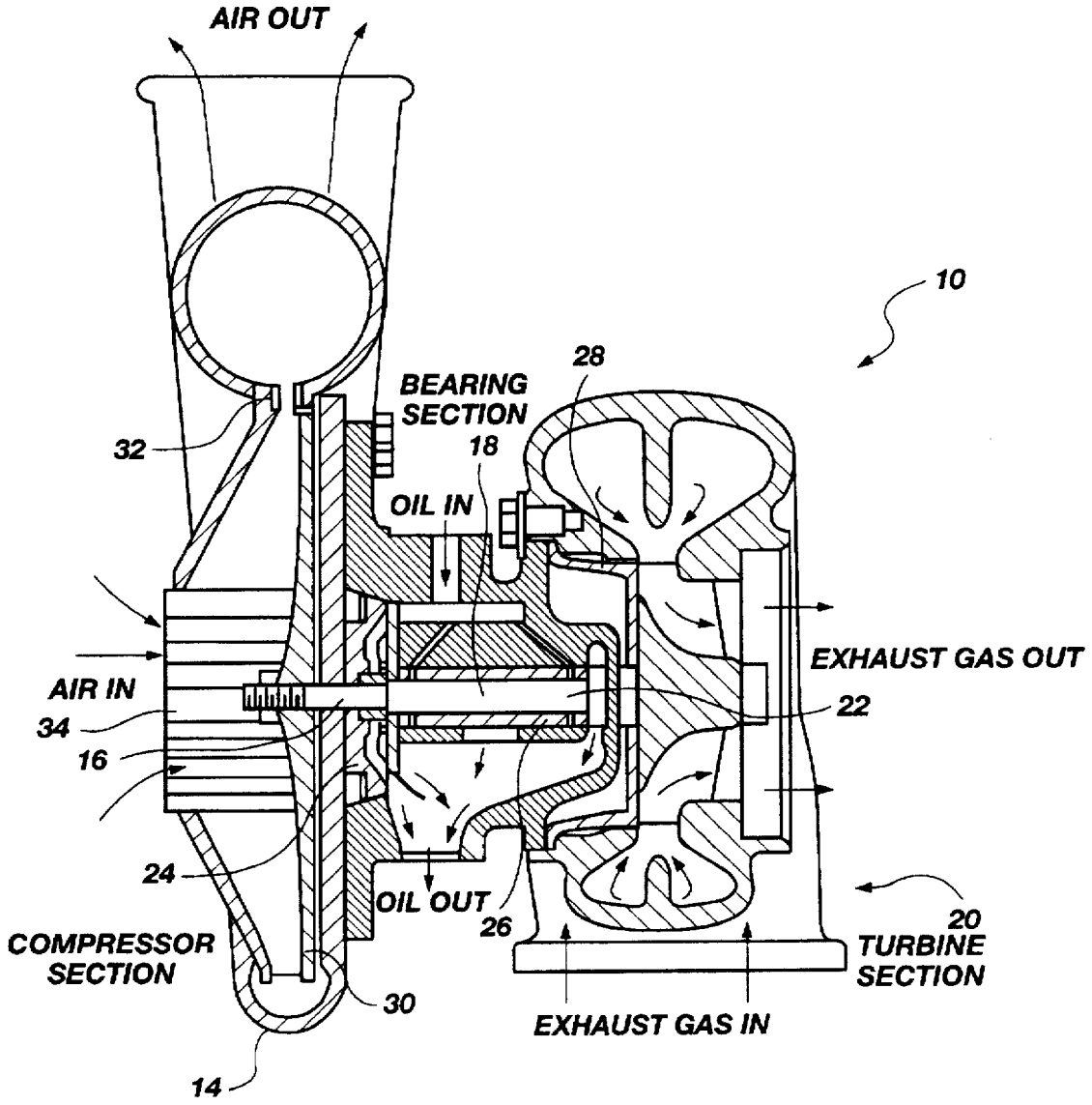
FIG. 1 is a cross sectional view of a turbocharger compressor and housing.

FIG. 1 is a side cross-section view of the turbocharger 10 driven by an exhaust driven turbine 20. The turbocharger 10 has a compressor section 14 on one end 16 of a shaft 18 connected to a exhaust driven turbine section 20 on the other end 22. The shaft 18 is bearing supported with seals 24 between the bearings 26 and the compressor section 14 and turbine section 20 to prevent high pressure gases from leaking into an oil-drainage area of the housing 28 supporting the bearings 26. The centrifugal compressor section 14 of the turbocharger 10 has three main elements: the impeller 30, the diffuser 32, and the housing 28.

The impeller 30 is mounted within a housing 28 having an air intake 34 and has a shaft 16 driven by the turbine section 20 to rotate the impeller 30 at very high speeds to accelerate gases passing therethrough to a high velocity by centrifugal force into a collector diffuser 32. The diffuser 32 shown is of a volute shape and acts as a nozzle in reverse to slow down the gas without turbulence. This slowed down the gas with increased pressure and temperature is directed by the diffuser 32 into the air inlet of an internal combustion engine as shown in the drawing.

Figure 1A:
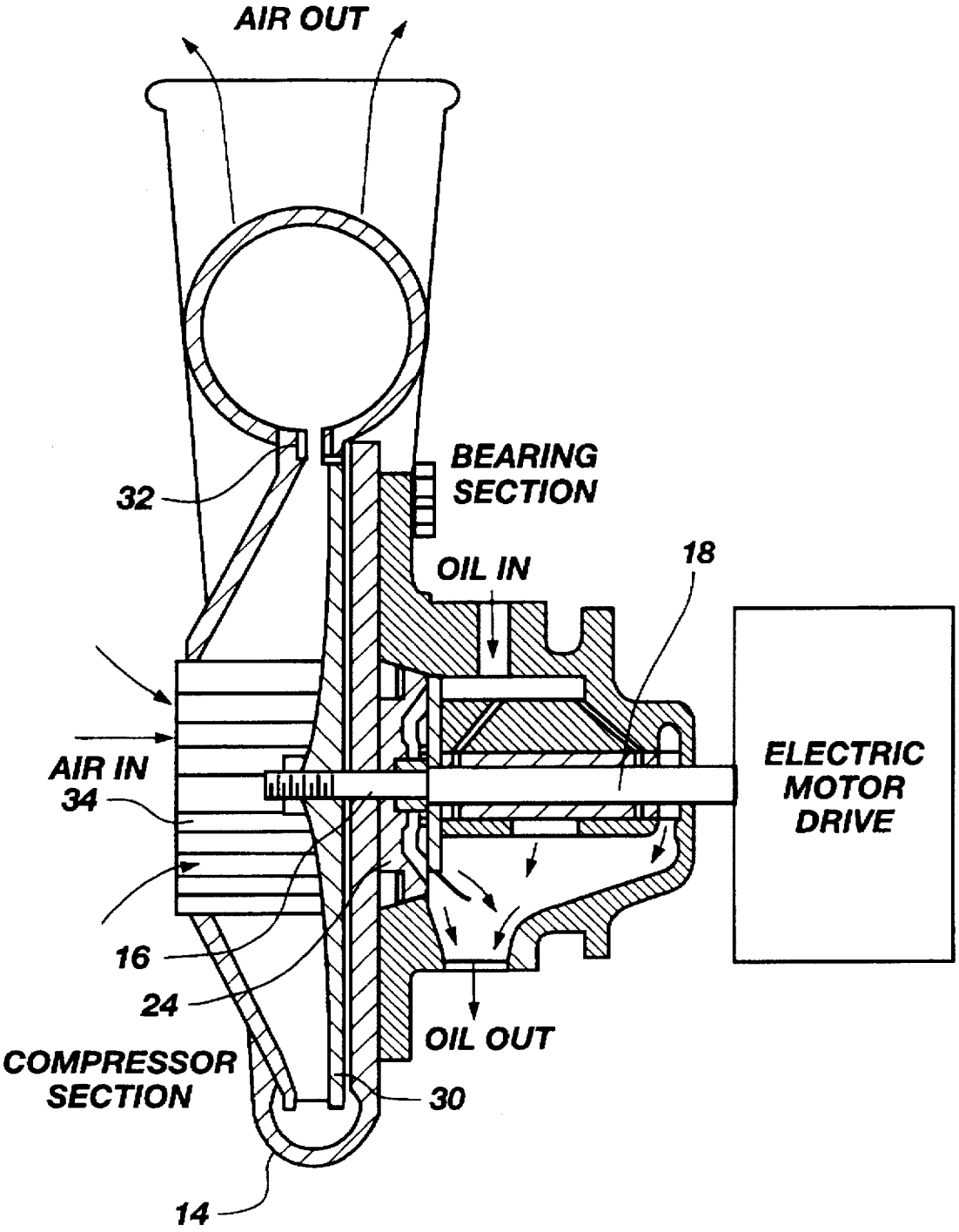
FIG. 1*a* is a cross section view of the turbocharger compressor and housing shown in FIG. 1 with an electric motor drive.
Figure 1B:
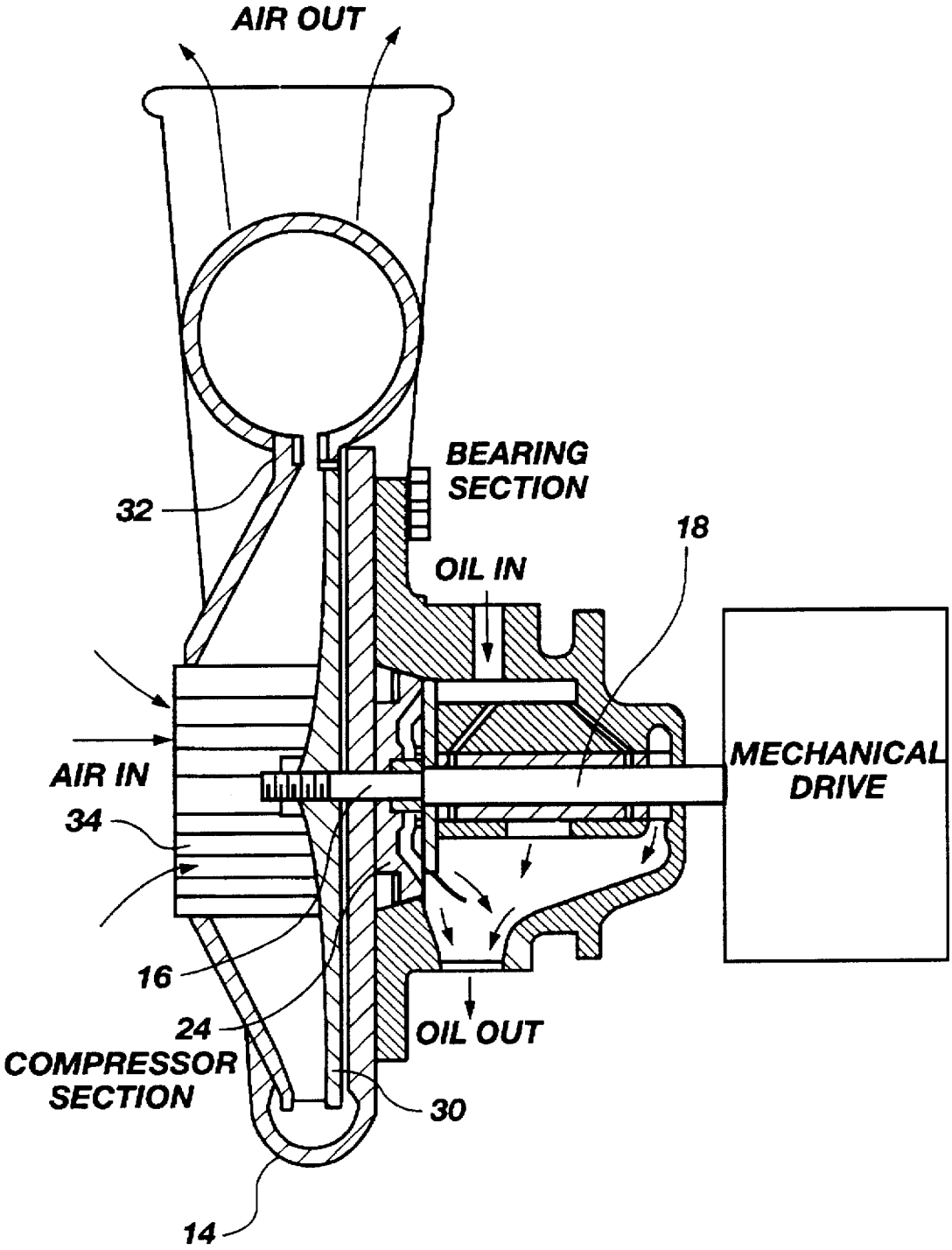
FIG. 1*b* is a cross section view of the turbocharger compressor and housing shown in FIG. 1 with a mechanical drive.
Figure 1C:
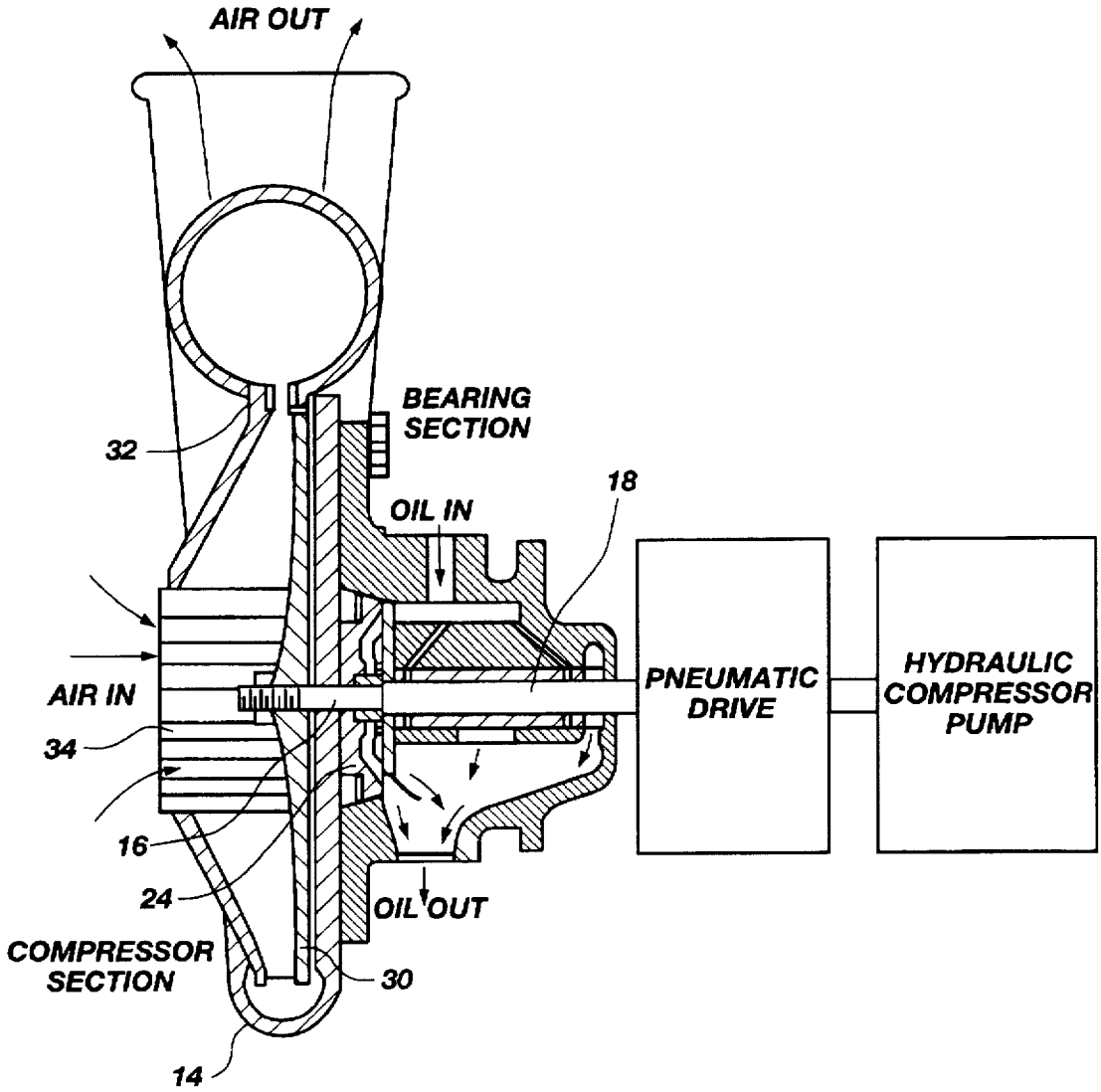
FIG. 1*c* is a cross section view of the turbocharger compressor and housing shown in FIG. 1 with a pneumatic drive and hydraulic compressor pump.

FIG. 1*a* is a cross section view of the turbocharger compressor and housing shown in FIG. 1 adapted with an electric motor drive. FIG. 1*b* is a cross section view of the turbocharger compressor and housing shown in FIG. 1 adapted with a mechanical drive. FIG. 1*c* is a cross section view of the turbocharger compressor and housing shown in FIG. 1 with a pneumatic drive and hydraulic compressor pump.

Figure 2:
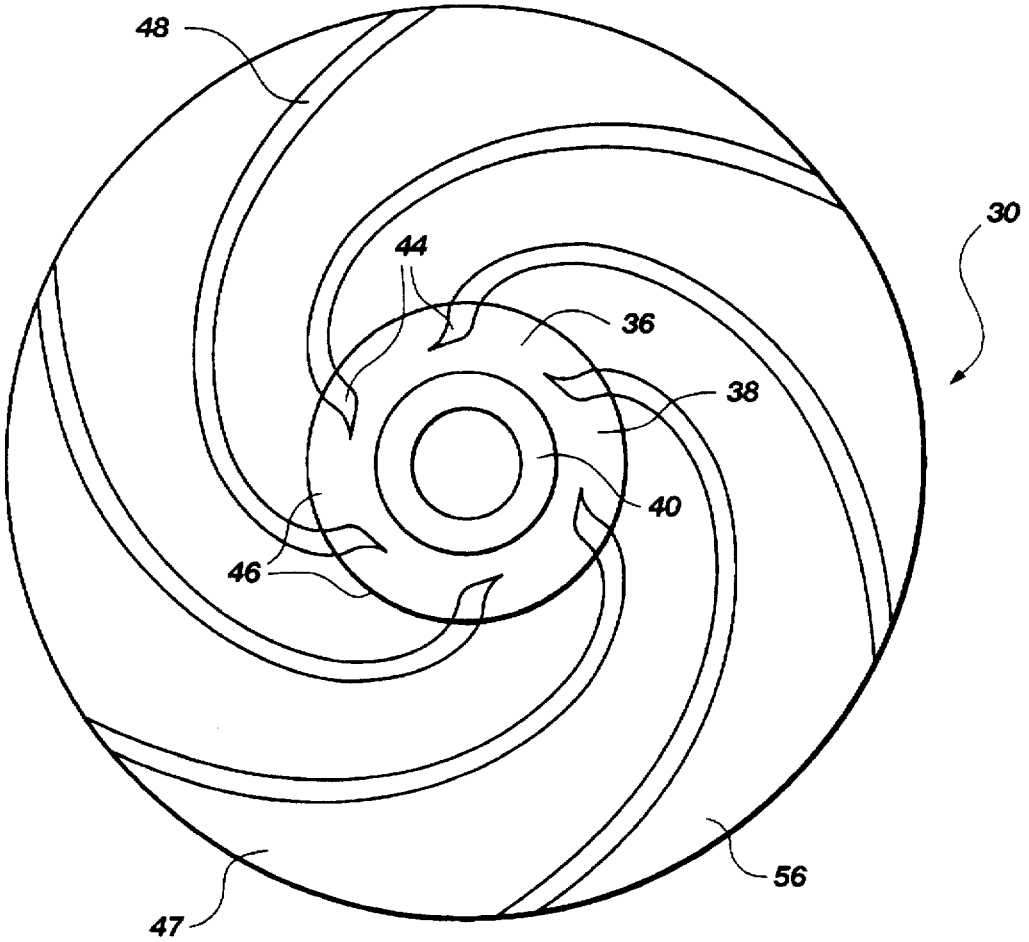
FIG. 2 is a top view of the improved impeller.

FIG. 2 a top view of the improved impeller 30. The impeller 30 has an elevated cylindrical auxiliary blades fan 36 defining an open top 38 leading into an interior gas intake opening 40 in communication with the housing gas inlet 34 mounted in the center of the top of the disc 42. A plurality of fan blades 44 surrounding the centered gas intake opening 40 and define fixed cross section fan blade outlets 46 therebetween.

Figure 3:
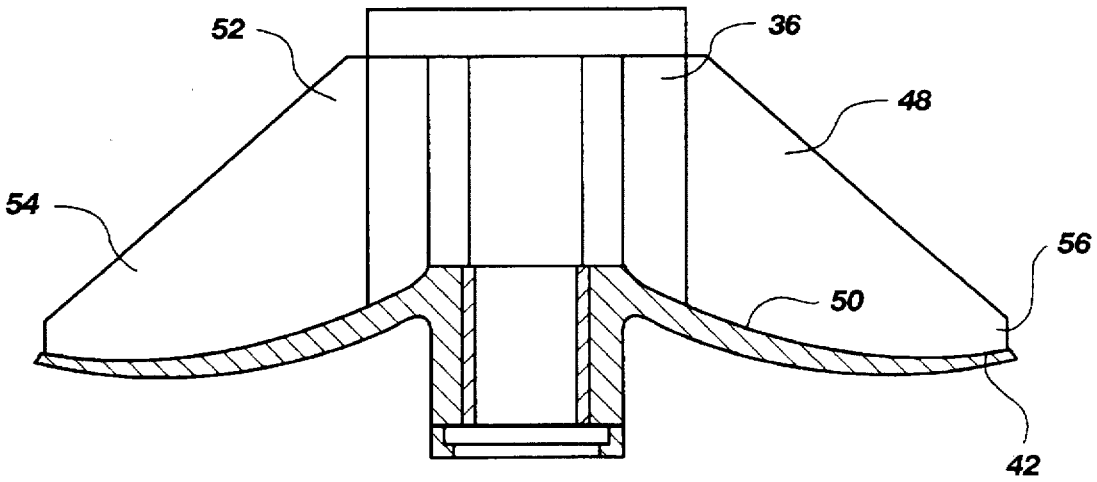
FIG. 3 is a side view of the improved impeller.

An inducer segment 47 surrounds the auxiliary blades fan segment 36. It comprises a plurality of curved downward sloping impeller inducer blades 48 secured to the periphery of the fan blades 44 proximate the fan blade outlets 46, and the sloping undersurface 50 of the top of the disc 42 shown in FIG. 3 and extending radially in a radial sloping wheel configuration such that each impeller inducer blade 48 curves away from the direction of disc rotation so the angle of curvature at the fan blade outlet 46 allows the air entering the impeller inducer segment 36 to be at approximately the same angle as the blades 44 to minimize inlet losses.

Figure 5:
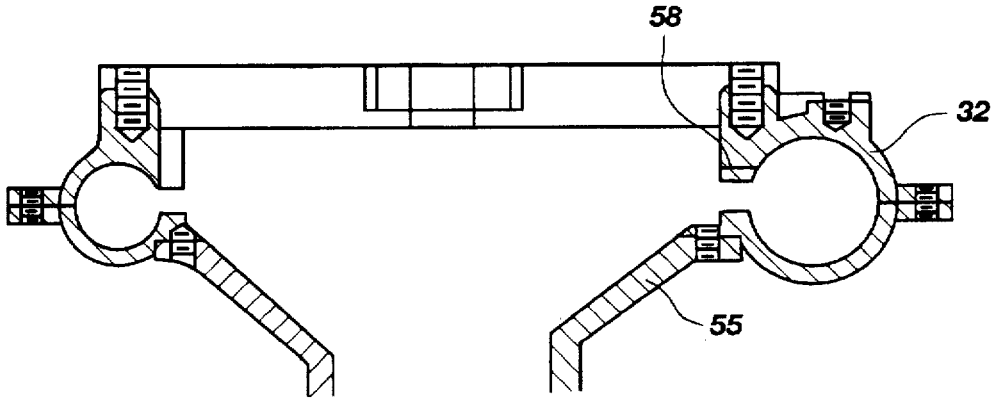
FIG. 5 is a sectional side view of the housing diffuser.

The inducer blades 48 each have an inner elevated leading edge 52 and an outer trailing edge 54 so the height of each inducer blade 46 decreases from the leading edge 52 to the trailing edge 54 to form when inserted on seating structure 55 shown in FIG. 5, undersurface flow channels which are downwardly open along their length and of a constant cross-section area throughout the length of each channel to minimize restriction of gas flows therethrough and out an inducer gas outlet 56 which is of the same cross-sectional area as the fixed cross sections of the fan outlets 46.

A conventional centrifugal gas diffuser 32 shown in FIG. 1 surrounds and is in communication with each inducer gas outlet 46 to collect the gases accelerated by the improved impeller 30 and slows the gas down to convert gas velocity energy into increased pressure. The diffuser 32 then directs the increased pressure gas into an internal combustion engine.

The number of inducer blades 48 may be increased or decreased in proportion to the ration of the diameter of the impeller, such that as the diameter of the impeller 30 is increased, the number of inducer blades 48 may be increased. The efficiency of the turbocharger 10 increases as the number of blades 48 increases. However, the circumference of the cross-sectional area of the air inlet 34 limits the number of blades 48 which may be installed.

Figure 4:
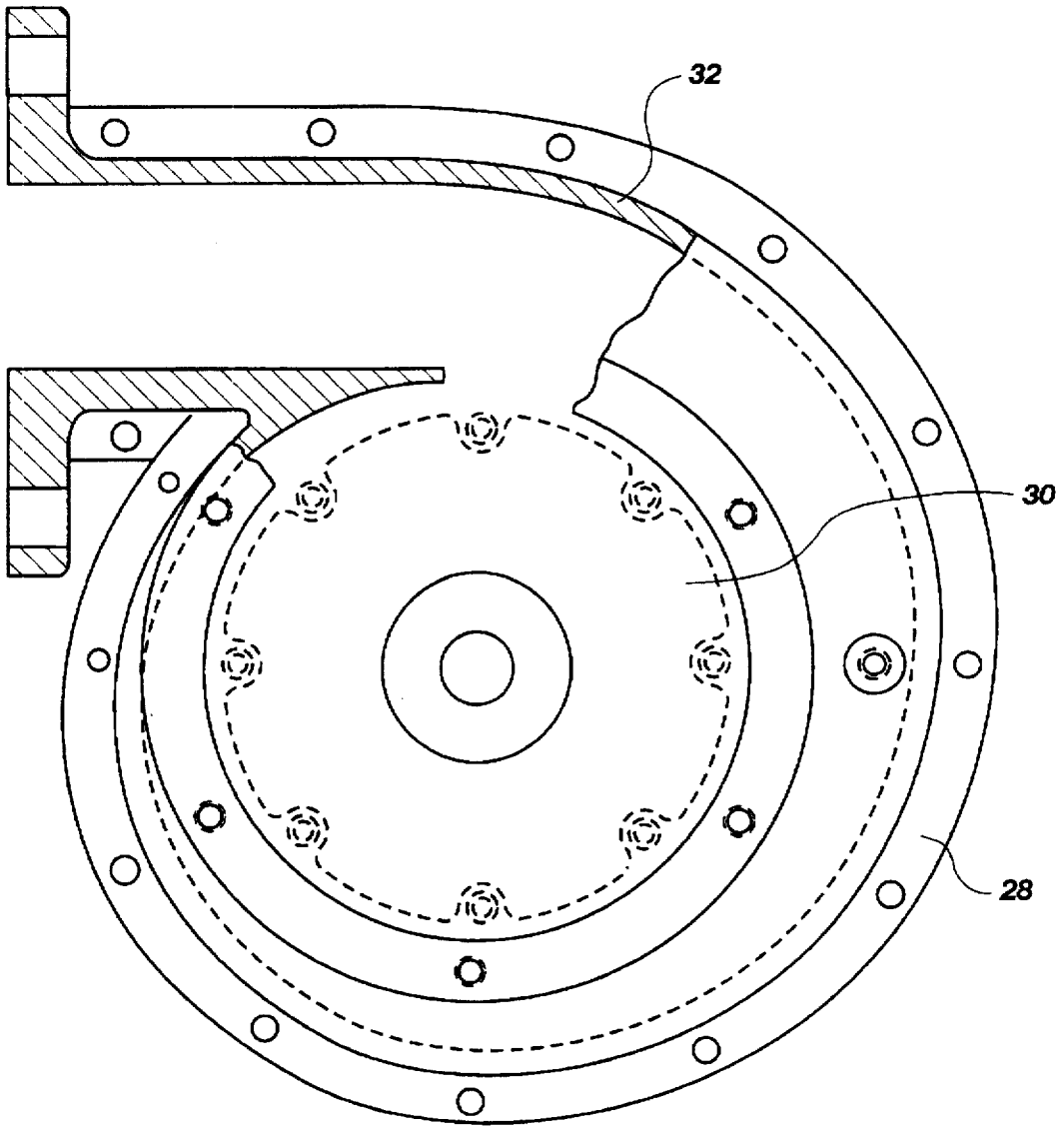
FIG. 4 is a top view partly in section of the improved impeller.

FIG. 4 illustrates a top view of the impeller 30 mounted within the housing 28. FIG. 5 is a side view of the housing 28 diffuser 32 shown as a volute shape with slot restrictions 58 which acts as a nozzle in reverse to slow down the gas without turbulence. The housing 28 is shown in two halves machined in a lathe.

Figure 6:
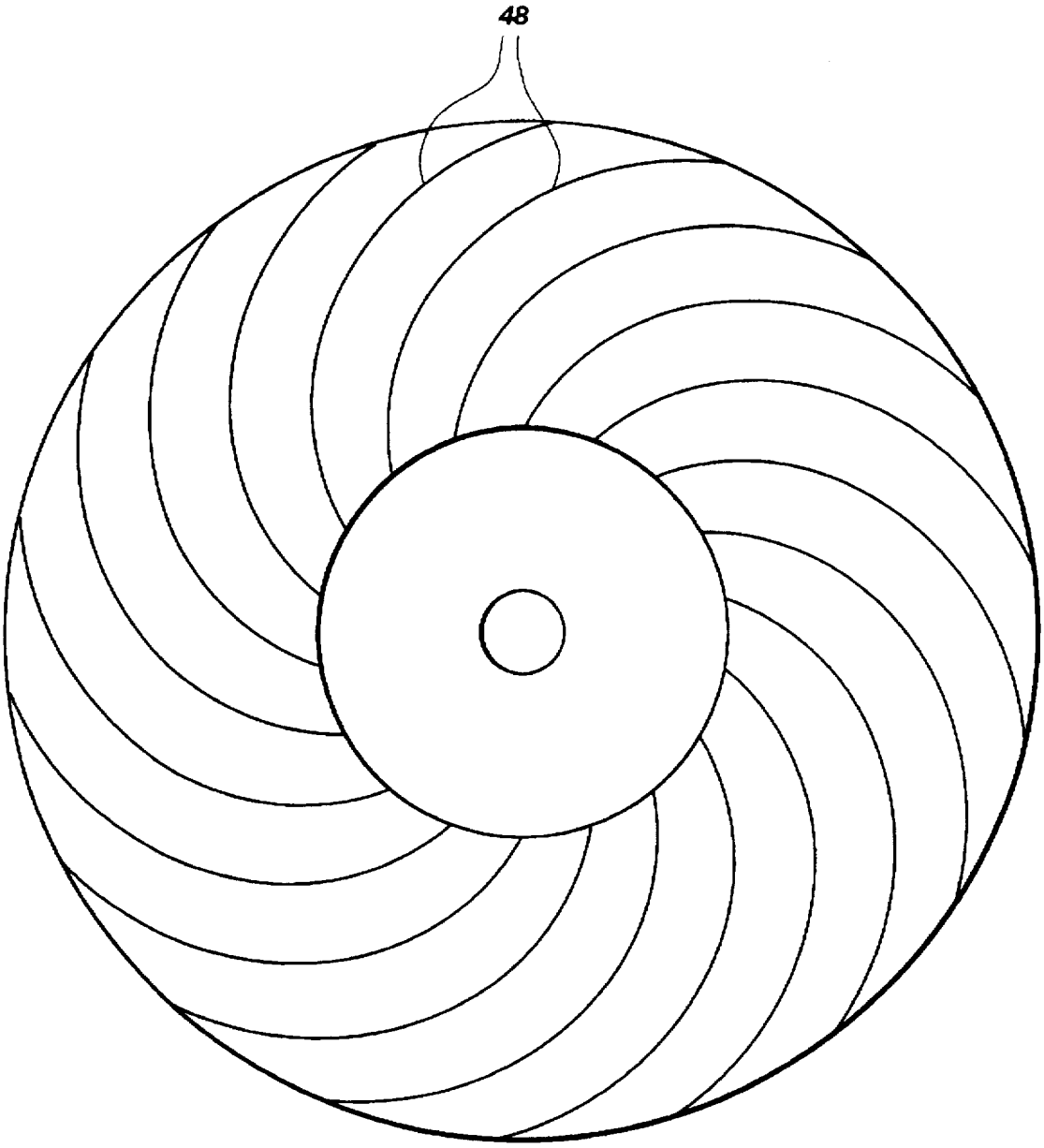
FIG. 6 is a top view of another embodiment of the impeller.

FIG. 6 is a full scale cross sectional view of an impeller 30 for a turbocharger 10 used in a 250 to 350 horsepower diesel engine. These diesel engines typically employ a turbocharger 10 having an impeller housing 28 of approximately 8 inches in diameter. The new impeller 30 therefore has a diameter of approximately 7.5 inches, leaving a ¼ inch spacing outside the impeller inducer blades 48 between the housing 28 to provide a high velocity air flow. However, the exact spacing may vary depending upon the air flows desired.

The thickness of the impeller inducer blades 48 are approximately 1/16 inch and are made of an aluminum alloy to withstand high speeds. The reduction in the impeller inducer blade 48 thickness not only makes the impeller lighter, but provides more area between the impeller inducer blades 48.

A typical impeller 30 has an cylindrical auxiliary blades fan 36 defining an open top 38 having an inlet diameter of 3 inches, with a circumference of 9.42 inches. The diameter of the outside of the impeller 30 is approximately 7.5 inches, which a diameter of approximately 23.55 inches. There are approximately 18 fan blades 44 surrounding the centered gas intake opening 40 which define fixed cross section fan blade outlets 46 therebetween of approximately 1.05 inches in height. The centers of the blades 44 are approximately ½ inch apart and the blades approximately 1/16 inch thick, leaving spaces therebetween of approximately 0.375 inches apart. Thus, the fan blade outlets 46 are 1.05 inches by 0.375 inches.

The inducer blades 48 each have an inner elevated leading edge 52 of approximately 1.05 inches in height, and an outer trailing edge 54 of approximately 0.375 inches in height so the height of each inducer blade 46 decreases from the leading edge 52 to the trailing edge 54 to form gas outlets 56 which are of the same cross-sectional area as the fixed cross sections of the fan blade outlets 46.

This impeller 30 produces at least 2 to 3 atmospheres of pressure which are more than sufficient to meet the engine needs at various operating speeds. Thus, this new design compares favorable with street vehicle turbochargers which produce 8 to 10 psi, and older diesel turbochargers which produce 25 to 30 psi.

Although the foregoing specification has referred to the illustrated embodiments, it is not intended to restrict the scope of the appended claims. The claims, themselves, recited those features deemed essential to the invention.

I claim:

1. A turbocharger compressor fan and housing comprising:

said housing defining a gas inlet leading into an interior compression chamber with a seating structure, an impeller rotatably mounted and seated within the seating structure in the interior compression chamber such that the impeller is in communication with the gas inlet, said impeller having a. a drive segment comprising i. a circular impeller disc with an elevated central mounded top forming a sloping surface and a bottom, ii. a drive shaft attached to centrifugal drive means being mounted to the housing and attached to the center of the bottom of the impeller disc, b. an auxiliary blade fan segment comprising i. a cylindrical auxiliary blade fan defining an open top and having a bottom mounted on the central mounted top, the open top having an interior gas intake opening aligned in communication with the housing gas inlet, ii. a plurality of fan blades surrounding the gas intake opening and defining fixed cross section fan blade outlets therebetween, and c. an inducer segment surrounding the auxiliary blade fan segment comprising:

a plurality of curved downward sloping impeller inducer blades secured to the periphery of the fan blades proximate the fan blade outlets and the sloping surface of the top of the disc and extending radially therefrom in a radial sloping wheel configuration such that each impeller inducer blade i. curves away from the disc's direction of rotation so the angle of curvature at the fan blade outlet allows the air entering the impeller inducer segment to be at approximately the same angle as the fan blades to minimize inlet losses; and ii. has an inner elevated leading edge and an outer trailing edge so the height of each inducer blade decreases from the leading edge to the trailing edge to form with the seating structure surface flow channels which are downwardly open along their length and of a constant cross-section area throughout the length of each channel to minimize restriction of gas flows therethrough and out inducer gas outlets which are of the same cross-sectional area as the corresponding fixed cross sections of the fan blade outlets; and centrifugal gas diffuser means having structure to surround and be in communication with each inducer gas outlet to collect gases accelerated by the impeller and slow the gases down to convert gas velocity energy into increased pressure gases and direct the increased pressure gases into an internal combustion engine.

2. A turbocharger compressor fan and housing according to claim 1, wherein the centrifugal gas diffuser means comprises a scroll type structure consisting of a volute or snail shape surrounding the outside of the impeller and having a cross-sectional area increasing in proportion to the amount of gas coming from the impeller disc.

3. A turbocharger compressor fan and housing according to claim 1, wherein the centrifugal gas diffuser means comprises a parallel wall diffuser structure which increases in area from the inside diameter of the diffuser structure to the outside diameter such that gas flowing in a radial direction has a gas velocity at the outer diameter of the diffuser structure considerably less than at the inner diameter of the diffuser structure.

4. A turbocharger compressor fan and housing according to claim 1, wherein the centrifugal gas diffuser means comprises a vane-type diffuser structure having a plurality of curved vanes designed so that their leading edges will be in line with the direction of gas flow from the impeller disc such that the vane curvature will force the gas to flow.

5. A turbocharger compressor fan and housing according to claim 1, wherein the drive means comprises a turbine associated with and driven by an internal combustion engine exhaust.

6. A turbocharger compressor fan and housing according to claim 1, wherein the drive means comprises an electric driven motor.

7. A turbocharger compressor fan and housing according to claim 1, wherein the drive means comprises a mechanical drive powered by the internal combustion engine.

8. A turbocharger compressor fan and housing according to claim 1, wherein the drive means comprises a separate pneumatic drive powered by an hydraulic compressor pump.

* * * * *